US009145025B2

(12) United States Patent
Nazlian

(10) Patent No.: US 9,145,025 B2
(45) Date of Patent: Sep. 29, 2015

(54) PAINT CAN HALO

(71) Applicant: John Nazlian, Saint Petersburg, FL (US)

(72) Inventor: John Nazlian, Saint Petersburg, FL (US)

( * ) Notice: Subject to any disclaimer, the term of this patent is extended or adjusted under 35 U.S.C. 154(b) by 90 days.

(21) Appl. No.: 14/051,085

(22) Filed: Oct. 10, 2013

(65) Prior Publication Data

US 2015/0102045 A1 Apr. 16, 2015

(51) Int. Cl.
*B44D 3/00* (2006.01)
*B44D 3/12* (2006.01)

(52) U.S. Cl.
CPC ..... *B44D 3/006* (2013.01); *B44D 3/128* (2013.01)

(58) Field of Classification Search
CPC ..... B44D 3/123; B44D 3/128; B44D 3/12; B44D 3/006
USPC ..... 220/697, 698, 699, 700, 701, 695, 736, 220/735
See application file for complete search history.

(56) References Cited

U.S. PATENT DOCUMENTS

| | | | | | |
|---|---|---|---|---|---|
| 1,547,541 | A | * | 7/1925 | Wansner | 220/702 |
| 2,151,895 | A | * | 3/1939 | Carlson | 220/697 |
| 2,722,347 | A | * | 11/1955 | Henke | 222/570 |
| 2,873,881 | A | * | 2/1959 | Nichols | 220/697 |
| 3,727,792 | A | * | 4/1973 | Levin | 220/700 |
| 4,312,459 | A | * | 1/1982 | Leach | 220/256.1 |

* cited by examiner

*Primary Examiner* — Robert J Hicks

(57) ABSTRACT

The present invention overcomes the problems inherent in the use of a paint can and paintbrush to contain the spread of errant paint from accumulating on the rim, outer portion of the can, and otherwise spreading externally.

The device comprises a top member that is designed to fit over the entire top of a conventional paint can, and an outer wall extending down the exterior side wall of the can, which includes an internal bead with contoured surface along the bottom circumference thereof forming a secure grip on the can. The outer wall has a curved and angled bottom edge, also slotted relief gaps, both design for fast and easy installation and removal of the device.

The device further includes an inner lip shielding the interior side of the paint can rim, and a flat section along the device interior used for scraping off paint.

18 Claims, 4 Drawing Sheets

PAINT CAN HALO

REFERENCE TO RELATED APPLICATIONS

This patent application claims the benefit of U.S. Provisional Application No. 61/751,626 filed on Jan. 11, 2013, the disclosure of which is incorporated herein by reference in its entirety.

BACKGROUND OF THE INVENTION

1. Field of the Invention

The present invention relates to a paint can, and more particularly a paint can cover that fits over the top of a conventional paint can to shield the rim of the can to prevent the accumulation of paint.

2. Description of Related Art

When using a paintbrush and paint can it is common to dip the brush directly into the can and then wipe off the excess paint on the edge of the rim. This act also applies to the use of a paint stirrer, or stirring stick. As can be appreciated, this causes the paint to accumulate within the lid sealing groove and on the rim, which will subsequently overflow down the exterior of the can. While exposed to air a portion of the paint will begin to dry, thus adding to the built up the paint accumulation.

If the accumulated paint is not removed before replacing the paint can lid, the remaining liquid portion will seep out when the lid is replaced. That seepage results in the paint spreading onto the surrounding outside of the can, lid, and any objects it contacts. The portion of the remaining paint dries within the lid sealing groove.

Each successive reuse continues to increase the paint build up in the lid sealing groove, the rim, and lid which makes it increasingly difficult to form an airtight seal. The failure of an airtight seal causes a portion of the paint composition to evaporate, which changes the overall pigmentation and consistency of the paint, and causes a thick skin to form atop the paint. Subsequently the paint will not coat as the original contents, nor match the original color. Additionally, most paint compositions emit vapors. These escaping fumes may be odorous and volatile, and potentially problematic.

Furthermore the paint left to dry in the sealing groove and rim of the can will adhere to the lid as well. This forms an adhesion of the lid to the rim making it increasingly difficult to remove. As a result, an increase of force is required to remove the lid, which is then prone to deforming, hindering it from forming a uniform airtight seal.

Other devices have been disclosed in prior art that protect the paint can lid sealing groove. However these devices are more costly and the methods by which they attach themselves are troublesome to use. In addition, these prior art devices do not provide a means of shielding the entire rim and adjacent surface of the can, nor do they effectively direct the paint back into the can. Therefore it is desirable to have a device that can prevent the paint from collecting in the lid sealing groove and rim, as well as provide a means of wiping off the excess paint from a brush or stirrer, and return into the can. The device will also prevent the paint from building up on the paint can and lid, and minimize the buildup on device itself.

SUMMARY OF THE INVENTION

The present invention overcomes the problems inherent in cleaning and resealing a paint can after use with a device that prevents the accumulation of paint in the lid sealing groove, rim, and outside of the can. The device comprises a top member, inner lip, and adjoining outer wall, that is designed to fit over the top of a conventional paint can.

The top member protects the entire rim and top portion of the paint can from paint deposits to eliminate the need to clean those areas before replacing the lid, to enable the lid to maintain the original airtight seal between uses.

The inner lip directs errant paint from the brush or stirrer back into the can, and has a flat section for scraping excess paint off of the brush. The inner lip is also used for removing excess paint.

The outer wall of the device extends down the exterior of the can to protect the upper handling area of the can from errant paint deposits. The bottom edge of the wall is curved and angled such that it can be pushed down incrementally around the outside of the can with ease. This ease of installation method is also conversely applied when removing the device. The same outer wall includes a bead along its internal bottom circumference protruding inward and contoured to form a snug fit to prevent unseating of the device during use. The bead is enhanced with an adjoining filled section, or fillet, formed to create a continuous smooth surface of the interior side of the wall, so upon removing the device it slides over the extended rolled outer edge of the paint can rim.

The outer wall also employs slots to distribute the force of the interference fit, formed by the bead, during installation and removal of the device. Furthermore these slots accommodate mass production fabrication processes by the same principle.

The top member, inner lip, and outer wall work in conjunction to form a protective shield around the entire rim and outer upper portion of the paint can to prohibit the accumulation of paint thereon, which defines the principle embodiment of this device, as such this shield eliminates the inherent problems of such accumulation, which include but are not limited to: the errant paint spreading to the external areas of the can, forming a layered build up on the areas handled when replacing the paint can lid; paint seeping out when the lid is replaced, spreading onto any objects it contacts; residual paint drying within the sealing groove obstructing the formation of an airtight seal with the lid; accumulated paint in the sealing groove drying to the lid when it is replaced forming an adhesive type bond necessitating addition force to remove the lid, as such the lid is prone to deforming, thus inhibiting it from forming a uniform airtight seal; subsequent uses increase the paint deposits in the sealing groove and on the lid degrading the airtight seal causing a portion of the unused paint to evaporate, which in turn alters the pigmentation, consistency, and produces a thick skin atop the unused paint.

The device is designed to allow full accessibility and functionality of the convention paint can handle without interference to the handle or device itself during installation, removal, or use. And device can be used on plastic or metal paint cans.

The invention is a single piece apparatus in the shape of a ring made of durable plastic or materials of compatible characteristics suited to the application. Its economical design makes it disposable, however its sturdy construction permits reuse. Furthermore the method of attachment provides ease and simplicity of its use, distinguishing it from other cumbersome methods previously employed in prior art forms.

The device is manufactured using readily available materials, conventional fabrication processes, and standardized packaging, all to benefit the low cost, availability, and disposable convenience of the product.

The more important features of the invention have thus been outlined in order that the more detailed descriptions that follow may be better understood, and in order that the present contribution to the art may better be appreciated. Additional features of the invention will be described hereinafter and will form the subject matter of the claims that follow.

Before explaining at least one embodiment of the invention in detail, it is to be understood that the invention is not limited to the contents of the can. This invention is applicable to other products, such as but not limited to; paint, stain, primer, varnish, polyurethane, or other categories of products. Also it is to be understood that the phraseology and terminology employed herein are for the purpose of description and should not be regarded as limiting.

As such, those skilled in the art will appreciate that the conception, upon which this disclosure is based, may readily be utilized as a basis for the design or modification of other structures or methods for carrying out various applications the present invention. Therefore, the claims herein be regarded as including such equivalent constructions insofar as they do not depart from the spirit and scope of the present invention.

The foregoing has broadly outlined the preferred features of the present invention so that those skilled in the art may better understand the detailed descriptions of the invention that follow. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention, and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claims, and the accompanying drawings in which similar elements are given similar reference numerals.

FIG. 1 displays the essential features in accordance with principles of the present invention.

DESCRIPTION OF THE PREFERRED EMBODIMENT

The device in accordance with principles of the present invention may vary in shape and size. The device can be used with a variety of products, such as, but not limited to; paint, stain, primer, varnish, polyurethane, or other categories of products. The device can be used with plastic or metal cans.

Figure 1:
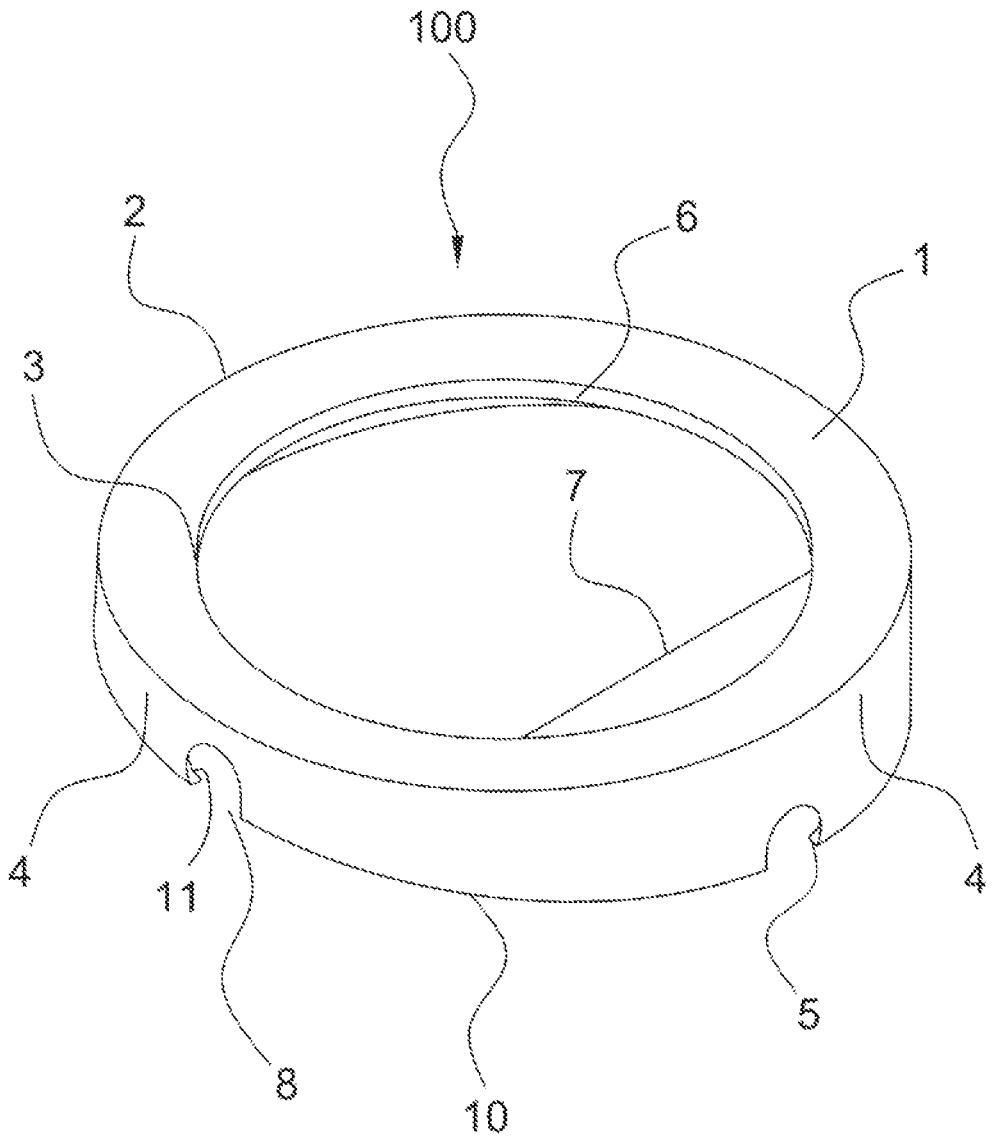
FIG. 1 is an isometric top view of the device showing the top ring, inner lip, scrape flange, outer wall with a tapered edge along the bottom, which is angular, curved, and terminated with a bead and filled section or fillet, and slots. These elements are integrally connected to their adjoining parts to form a single solid piece.

Referring now to FIG. 1, there is shown an isometric top view of the device 100 in accordance with the principles of the present invention. Each member thereof will be described in further detail in subsequent figures.

The device 100 is comprised of a top annular shaped member 1, referred to as top ring with an outer annual member 2 defining its outer perimeter, and inner annual member 3 defining its inner perimeter; inner lip 6, scrape flange 7, outer wall 4, tapered edge 10, bead 5, filled section or fillet 11, slots 8, and smooth edge trim (not shown).

Figure 2:
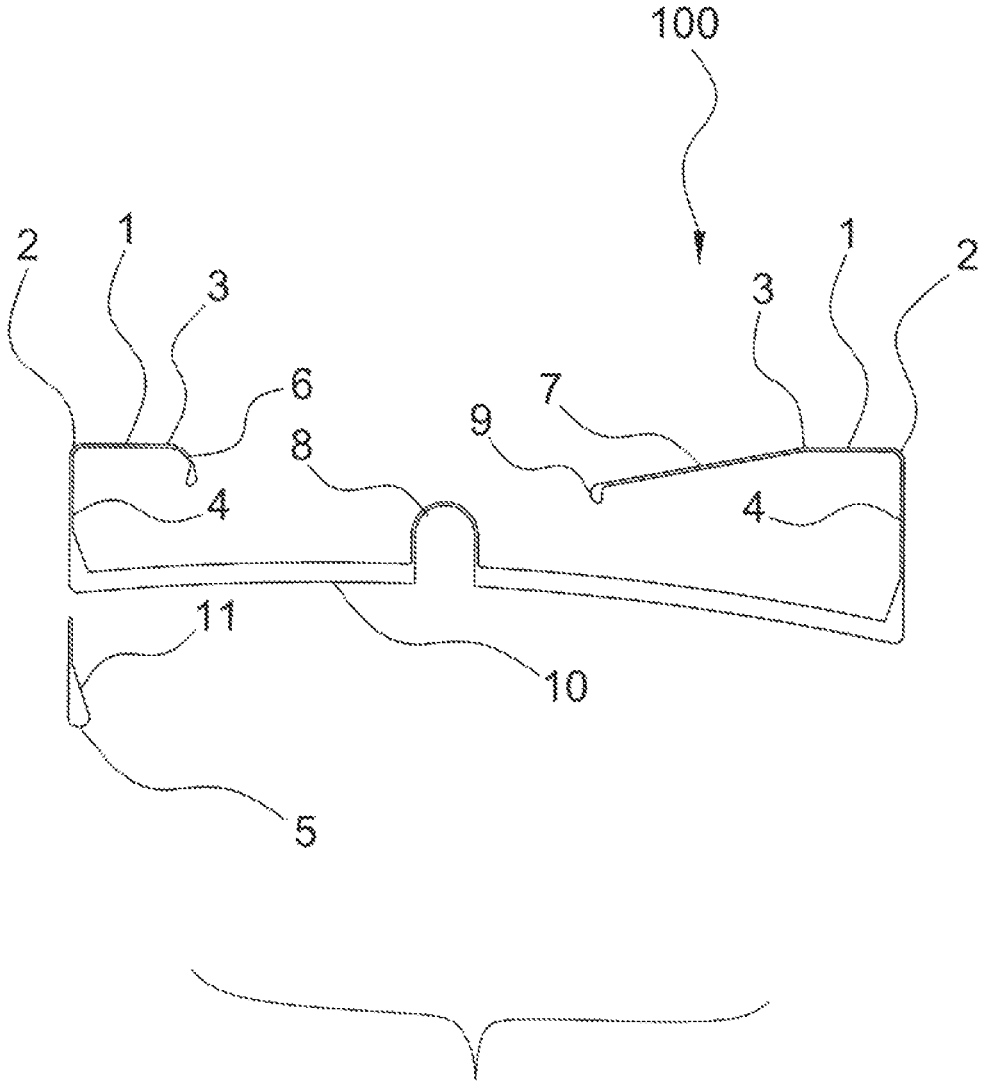
FIG. 2 shows a cross-sectional view of the device depicting the form and relations of the elements of the key embodiments of the invention.

Referring now to FIG. 2, there is shown a cross-sectional view of the device 100 depicting each member of the device. A more detailed description of their functions will be discussed in subsequent figures.

The top ring 1 forms a cover over the top surface of the can. The outer annual member 2 defines the outer edge of the top ring 1 and the inner annual member 3 defines the inner edge of the top ring 1. The inner lip 6 attaches to the annual member 3 extending inward and downward toward the interior of the device 100. The scrape flange 7 attaches to the inner annual member 3 and inner lip 6 extending inward and downward toward the interior of the device 100. Both the inner lip 6 and scrape flange 7 have a continuous smooth edge trim 9 radially formed along their interior edge.

The outer wall 4 attaches to the outer annual member 2 and extends perpendicular to the top ring 1 extending downward. The tapered edge 10 is curved and angled and defines the bottom extent of the outer wall 4. The bead 5 is radially formed and protrudes inward toward the interior of the device 100 to form a continuous edge around the tapered edge 10. The fillet 11 attaches to the bead 5 and interior surface of the outer wall 4 to form a continuous smooth surface.

The slots 8 extend upward from the tapered edge 10 creating relief gaps in the outer wall 4. This segmentation of the lower section of the outer wall 4 is the means by which the device is allowed to gradually engage the outer rolled edge of the paint can 33 (see FIG. 3) to distribute the force employed during installation and removal of the device 100. This same principle of distributed force will also accommodate methods employed during the mold ejection operations used in mass manufacturing processes.

Figure 3:
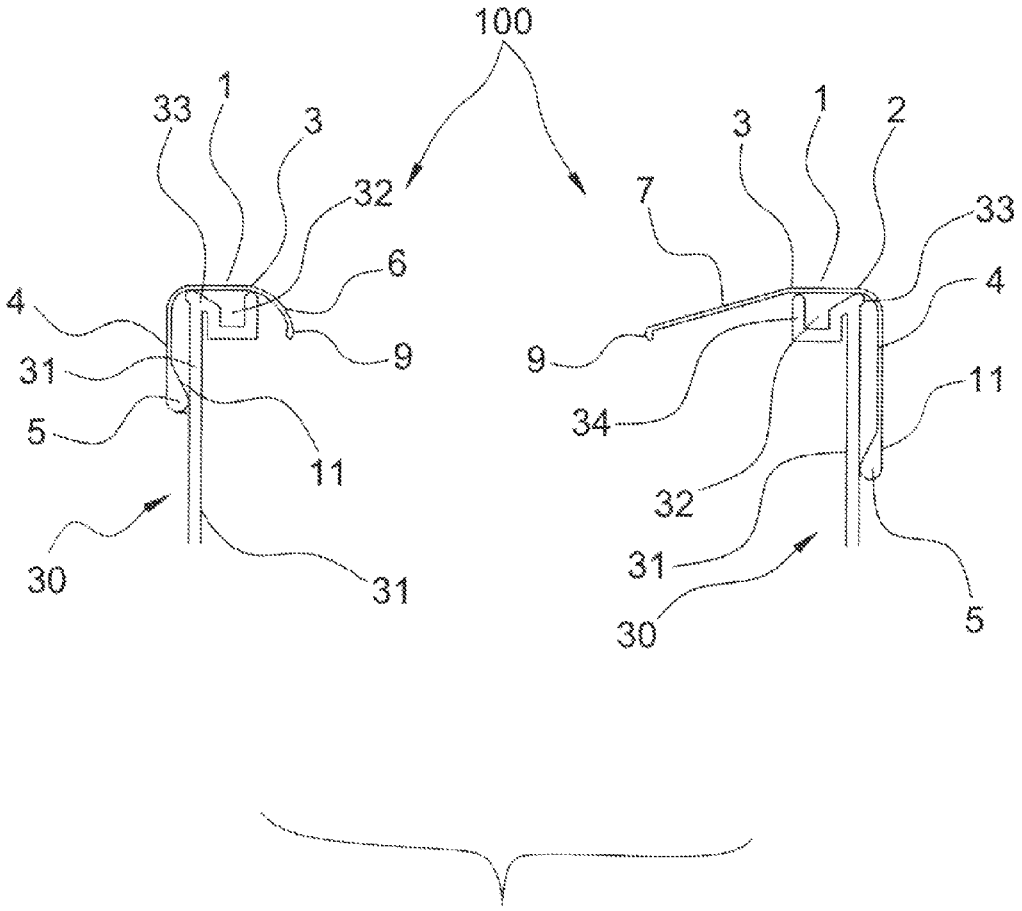
FIG. 3 is a cross-sectional view of the device installed on a conventional paint can, depicting the can side wall, and rim structure. This view illustrates the key characteristics of the invention; the method of attachment by which it securely retains the device during use, also the fully encompassing extent by which the device protects the entire can rim structure and upper outer section from errant paint deposits.
Figure 4:
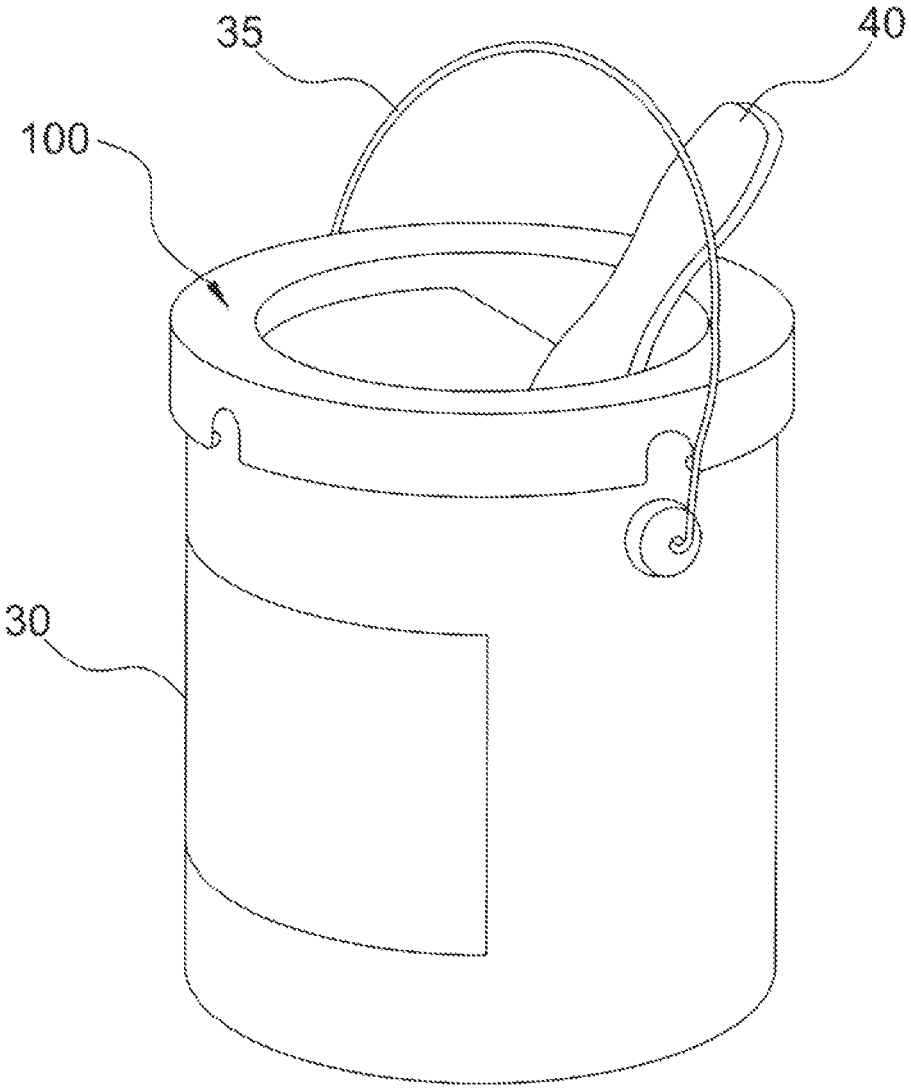
FIG. 4 is an isometric view of the device installed on a conventional paint can, wherein the device is seen as fully protecting the entire can rim structure and top outer portion of the can. Also shown is the paint can handle, and a paint stirring stick shown to illustrate the principle function of the device as it is intended to serve the use of brushes, stirrers, or other implements used in the application of this invention.

Referring now to FIG. 3, there is shown a cross-sectional view of the device 100 installed on a conventional paint can 30 (see FIG. 4).

The top ring 1 covers the entire top surface of the paint can 30 to protect it from the accumulation of paint. The inner lip 6 forms a continuous shield around the internal circumference of the can rim structure 34, it curves inward and downward toward the center of the device 100 directing errant paint back into the can. This prevents errant paint from accumulating within the lid sealing groove 32. The combined effect of the top ring 1 and inner lip 6 prevent the accumulation of paint as it would eventually form built up deposits within the lid sealing groove 32 and can rim structure 34, which degrades their ability to form the airtight seal necessary to preserve the integrity of the remaining paint between uses. This protective act also prevents errant paint from otherwise spreading externally. The inner lip 6 is formed to facilitate the removal of excess paint off a paintbrush or other implements and direct it back into the can.

The scrape flange 7 is formed as a straight edge within the interior of the device 100, which serves as a flat surface with which a paintbrush or other implement may use to remove excess paint. It is formed inward and downward toward the center of the device 100 to direct excess paint back into the can. The flange scrape 7 also provides a resting place for a brush or other implements when not in use.

The smooth edge trim 9 runs continuously along the internal edge of the inner lip 6 and scrape flange 7. It is radially contoured to minimize friction as a paintbrush or other implement is drawn upward against it while removing excess paint. This resulting smooth action inhibits the device 100 from unseating during use.

The outer wall 4 extends perpendicular and downward from the top ring 1 to surround the upper outer portion of the paint can. It provides the structural support required by its requisite members integrated on its bottom edge. The outer wall 4 shields the upper outer portion of the paint can from paint deposits forming on the handling area of the can.

The tapered edge 10 (see FIG. 2) defines the bottom edge of the outer wall 4, and is curved and angled such that it can be installed or removed incrementally around the outer top extent of the paint can. By shaping the edge in this fashion it affords a smooth application of force to gradually install or remove the device 100, while efficiently simplifying the task add and effort required.

The bead 5 is radially formed as a continuous annual rim extending along the interior of the tapered edge 10 protruding inward. By forming the bead 5 as such it applies a slight interference fit against the paint can outer wall 31. This attachment method comprises the unique characteristic enabling the device 100 to be installed and removed with speed and ease, and to maintain a snug fit to inhibit unseating during use.

The junction of the outer wall 4 and bead 5 includes a fillet 11, which is integrally connected to those members to form a continuous smooth surface. The fillet 11 enables the outer wall 4 to gradually flex outward to facilitate easy removal of the device with minimal encumbrance of the paint can rim outer rolled edge 33. The fillet 11 institutes the same principle function during mold ejection operations used in mass manufacturing.

Referring now to FIG. 4, there is shown an isometric view of the device 100, conventional paint can 30, paint can handle 35, and paint stirring stick 40. This view illustrates the embodiments of the invention showing the device 100 installed on a paint can 30 in a typical application.

The device 100 shields the entire internal and external portions of the paint can rim structure 34 (see FIG. 3) and outer top section of the paint can 30 from the accumulation of paint. Having such errant paint deposits leaves residual paint left to dry on the rim structure, which will adhere to the paint can lid (not shown) when replaced, acting as a bonding agent causing the lid to stick to the rim of the can.

Furthermore a portion of those paint deposits seep out as the paint can lid is replaced, that seepage migrates to the handling areas used during the replacement of the lid. Thus the errant paint will spread to any objects it contacts.

The device 100 is designed to permit full accessibility and functionality of the paint can handle 35 so it is free to traverse without interfering with the device 100 when installed, removed, and during use.

The paint stirrer 40 is shown as it would be in a typical use. The design of the device 100 is optimized to permit free usage of a paintbrush, stirrer, or other implements to be used in their application. The scrape flange 7 and inner lip 6 both with the smooth edge trim 9 (see FIG. 2) create a low friction surface to effectively scrape excess paint off the implements and return it back into the can.

The device is expressly designed for implementation of this device with a newly purchased can of paint. A painter can apply this device 100 directly upon unsealing a new paint can containing its total contents, while providing ample clearance to prevent any immersion of the device 100 into the paint. Furthermore the clearance is ample to permit the use of a stirrer, brush, or other implement to remove excess paint and freely return it back into the can.

The device 100 is formed as a one-piece apparatus in the shape of a ring, and is preferably constructed of plastic, closed-cell extruded polystyrene foam, or other materials suited to the application based on their economy and availability commensurate with the disposable nature of the device. The device can be used for a desired number of times and then disposed of. The device can be made to fit a variety of paint can sizes, typically one quart or one gallon sizes.

While there have been shown, described, and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings.

The embodiments discussed were chosen and described to provide the best illustration of the principles of the invention and its practical application to enable one of ordinary skill in the art to utilize the invention in various embodiments and with various modifications as are suited to the contemplated use. All such modifications and variations are within the scope of the invention as determined by the appended claims when interpreted in accordance with the scope and breadth to which they are entitled.

What is claimed is:

1. A one piece device for attaching to a top of a conventional paint can to prevent the accumulation of paint in a lid sealing groove, around a rim, and on an upper outer portion of the paint can, the device comprising: a top member that is designed to sit flush on top of the conventional paint can having an inner perimeter and an outer perimeter; an inner lip integrally connected to the inner perimeter of the top member and extending downward at a slope toward a center of the device; a scrape flange section integrally connected to a section of the inner lip and or inner perimeter, sloped downward at an angle toward the center of the device; a smooth edge trim extending around an entire interior edge of the inner lip and scrape flange section; an outer wall perpendicularly and integrally connected to the outer perimeter of the top member extending downward to surround the upper outer portion of the paint can, the outer wall having a tapered edge along its bottom, which is curved and angled; a bead radially shaped, protruding inward from the tapered edge; a fillet which forms a continuous smooth surface at the junction of the bead and outer wall; and slots extending upward from the tapered edge to create gaps in the outer wall.

2. The device of claim 1, wherein the top member is annular shaped and its outer perimeter defines the outer circumference of the device such that the to member protectively covers the entire top of the paint can to prevent the accumulation of errant paint deposits.

3. The device of claim 2, wherein the inner lip shields an entire interior of the paint can rim and provides a surface for removing excess paint off a brush or other implements, while preventing errant paint from accumulating on and in the rim of the can and directing the paint back into the can.

4. The device of claim 1, wherein the scrape flange provides a straight edge angled inward and downward toward the center of the device, well suited for scraping excess paint off a paintbrush or other implements while directing the paint back into the can, and provides a resting place for the brush when not being used.

5. The device of claim 1, wherein the smooth edge trim is a continuous, radially formed edge along the entire interior edge of the inner lip and scrape flange serving as the smooth edge by which the brush or other implement is drawn upward while removing excess paint, the smooth edge trim's function is to minimize the friction of such act to inhibit the device from unseating.

6. The device of claim 3, wherein the outer wall is perpendicularly attached to the top member outer circumference and extends downward to surround the upper outer portion of the paint can and shield the upper outer portion of the can from errant paint deposits accumulating on the areas of the can which are handled during replacement of a paint can lid.

7. The device of claim 1, wherein the tapered edge defines the bottom edge of the outer wall, the tapered edge is curved and angled in such a fashion to incrementally engage the outer most extent of the top of the paint can, affording a gradual and smooth application of the force required during installation or removal of the device.

8. The device of claim 1, wherein the bead is radially formed, protruding inward from an inner circumference of the tapered edge and is shaped to apply a slight interference fit against an outer wall of the paint can such that the device retains a fully seated position when installed and during use, providing a fast and easy means by which the device is secured to the paint can.

9. The device of claim 1, wherein the fillet is integrally attached to the bead on an interior side of the outer wall to create a smooth angled surface enabling the outer wall to gradually flex outward while overcoming the outer most extent of the top of the paint can during removal so as to incrementally distribute the extraction force of the device.

10. The device of claim 1, wherein the slots extend upward from the tapered edge to provide relief gaps in the outer wall and divide the outer wall into discrete segments and enable each of the discrete segments to flex outward incrementally, distributing the force which is applied during installation and removal of the device.

11. The device of claim 9, wherein the fillet is fashioned to distribute the force required to eject the device off of a mold which would be used during the mass manufacturing operations.

12. The device of claim 1, wherein the device is designed to permit full accessibility and functionality of a paint can handle so that the handle is free to traverse without interfering with the device when installed and during use.

13. The device of claim 1, wherein the device is designed for use with a full paint can providing ample clearance to prevent any immersion of the device into the paint, and provide adequate space above the paint to freely scrape excess paint off of a stirrer, brush, or other implements.

14. The devices of claim 6, wherein the top member, inner lip, and outer wall work in conjunction to form a protective shield around the entire rim and outer upper portion of the paint can to prohibit the accumulation of paint thereon.

15. The device of claim 1, wherein the device is constructed of plastic, closed-cell extruded polystyrene foam, or other suitable materials to the application based on their economy and availability commensurate with the disposable nature of the device.

16. The device of claim 1, wherein the device can be made to fit a variety of paint can sizes.

17. The device of claim 1, wherein the device can be used with a variety of products, including paint, stain, primer, varnish, polyurethane, or other categories of products.

18. The device of claim 10, wherein the slots are fashioned to distribute the force required to eject the device off of a mold which would be used during the mass manufacturing operations.

* * * * *